United States Patent [19]

Aylott

[11] 4,018,336

[45] * Apr. 19, 1977

[54] PACKAGING OF ARTIFICIAL EYELASHES

[75] Inventor: Eric V. Aylott, Cwmbran, Wales

[73] Assignee: Eylure Limited, Cwmbran, Wales

[ * ] Notice: The portion of the term of this patent subsequent to Feb. 3, 1993, has been disclaimed.

[22] Filed: Nov. 13, 1975

[21] Appl. No.: 631,557

Related U.S. Application Data

[63] Continuation-in-part of Ser. No. 447,436, March 1, 1974, Pat. No. 3,935,872.

[30] Foreign Application Priority Data

Aug. 3, 1973 United Kingdom ..... 36971/73
Sept. 26, 1973 United Kingdom ..... 45100/73

[52] U.S. Cl. ..... 206/460; 206/45.14; 206/813; 132/88.7

[51] Int. Cl.[2] ..... B65D 73/00; B65D 85/54; A45D 40/26

[58] Field of Search ..... 206/460, 461, 467, 470, 206/813, 45.14; 132/73, 78, 88.7, 53

[56] References Cited

UNITED STATES PATENTS

| | | | |
|---|---|---|---|
| 2,288,386 | 6/1942 | Belden | 132/73 |
| 3,063,557 | 11/1962 | Scholl | 206/469 |
| 3,165,639 | 7/1939 | Dahlgren | 206/460 |
| 3,315,689 | 4/1967 | Melik | 132/79 |
| 3,645,281 | 2/1972 | Seidler | 206/328 |

*Primary Examiner*—William T. Dixson, Jr.
*Attorney, Agent, or Firm*—Blum, Moscovitz, Friedman & Kaplan

[57] ABSTRACT

Eyelashes which are convex in side elevation and consist of a plurality of lashes held together by a base strand are removably mounted upon a supporting surface in such a way that the convex side of the set is in contact with the supporting surface whereas the base strand is left free.

4 Claims, 4 Drawing Figures

FIG. 1.
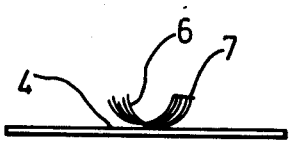
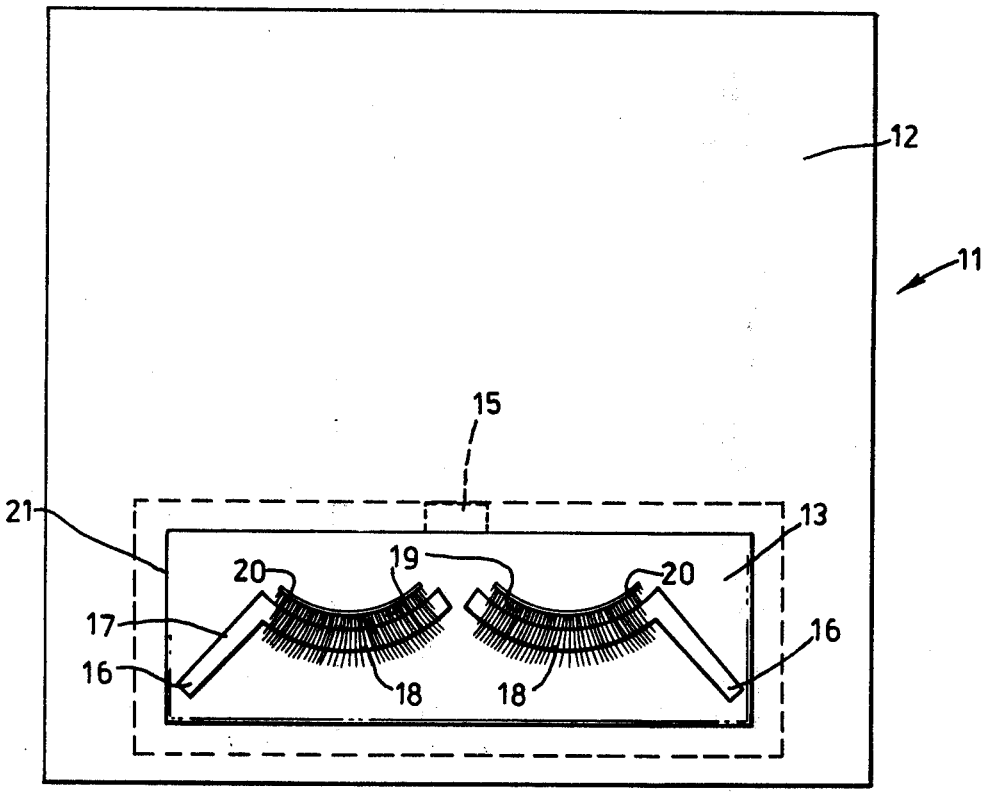
FIG. 3.

FIG. 2.
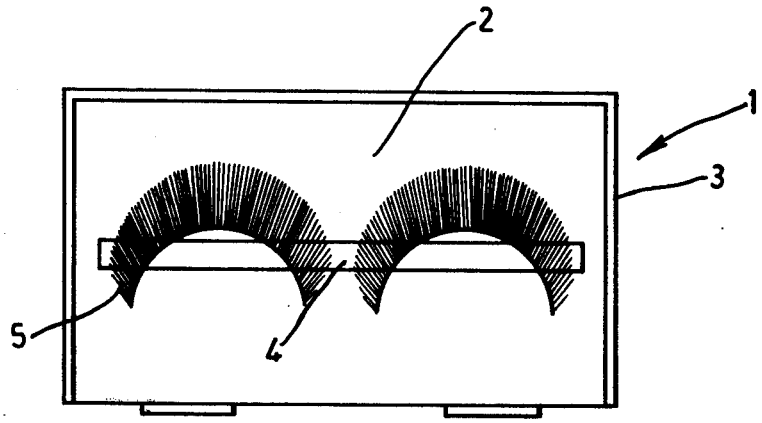
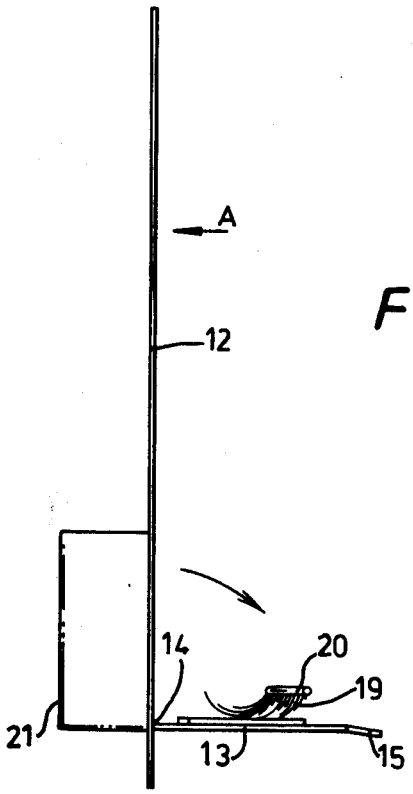
FIG. 4.

PACKAGING OF ARTIFICIAL EYELASHES

CROSS REFERENCE TO RELATED APPLICATIONS

This application is a continuation-in-part application of parent application Ser. No. 447,436 filed on Mar. 1, 1974, now U.S. Pat. No. 3,935,872.

FIELD OF THE INVENTION

This invention relates to the presentation and packaging of artificial eyelashes.

BACKGROUND OF THE INVENTION

At present artificial eyelashes are manufactured to have a base strand curved to the eye of the user to make the application of eyelashes as simple as possible. The eyelash sets are mounted side by side on vacuum formed insets in a pack and are attached to appropriately curved portions of the insets by means of a self-adhesive substance on the base strand of each set. In order to remove an eyelash set from a inset the eyelash set is gripped, for example by tweezers, and the base strand torn away from the curved portion to which it is attached. Unless this operation is effected very carefully the force used to remove the eyelash set from the inset will cause the eyelash set to be distorted and twisted out of shape so that the base strand loses much of its important curvature resulting in more difficult application of an eyelash set to a user's eyelid.

Moreover in many present proposals an eyelash set is mounted with its base strand precoated with adhesive with the intention that no further adhesive will be necessary before application to a user's eyelid. However experience has shown than even when a base strand is precoated in this way so much adhesive is left remaining on the inset after the eyelash set is torn away that on usage further adhesive has to be applied to the base strand for the eyelash set to be located securely as desired on a user's eyelid. In order to apply this necessary adhesive to the base strands, the eyelash sets have to be removed from their package. Thus, at present, the eyelashes have to be torn away from an inset mounting which often distorts the base strands curvature necessary for easy application, need to have adhesive applied to their base strands and have to be manipulated further to locate them in position. As clearly understood these operations mean that the eyelash sets have to be handled and as eyelash sets are fairly delicate items it will be understood that if the handling is reduced to a minimum the longer the eyelash sets will last.

It is therefore an object of the invention to provide an improved method of mounting eyelashes and an improved presentation pack including eyelashes mounted in accordance with the method.

SUMMARY OF THE PRESENT INVENTION

According to the present invention a method of mounting an eyelash set having a plurality of lashes held together by a base strand and which is convex in side view comprises removably mounting the eyelash set upon a supporting surface in such a way that the convex side of the set is in contact with the supporting surface and the base strand of the eyelash set is left free.

The invention also includes an eyelash presentation pack comprising a pair of eyelash sets each having a plurality of lashes held together by a base strand and being convex in side view and a supporting surface on which the eyelash sets are mounted, each eyelash set being mounted with its convex side in contact with the supporting surface so that the base strand of the eyelash set is left free.

In one embodiment of the invention the eyelash sets are each mounted on a removable applicator in the pack. By arranging the eyelashes in this way the base strands of the eyelash sets may be precoated with adhesive and left free so that they do not make contact with any surface prior to attachment to a person's eyelid. Moreover by mounting the eyelash sets on applicators an eyelash set can be removed from the pack and applied to a user's eyelid without the premounted eyelash set being touched at all.

In an alternative embodiment the eyelash sets are mounted directly onto a two-way adhesive tape stuck to the base of a presentation pack so that the eyelash set may not only be mounted convex side downwards but also may be readily replaced in the pack in the same disposition.

BRIEF DESCRIPTION OF THE DRAWINGS

The invention will now be described by way of example with reference to the accompanying drawings in which:

FIG. 1 illustrates the way in which an eyelash set is mounted;

FIG. 2 is a plan view of a presentation pack showing eyelash sets mounted in accordance with one embodiment of the invention;

FIG. 3 is a front plan view of a second embodiment of the invention and

FIG. 4 is a side elevation of the pack shown in FIG. 3 but with the pack opened.

SPECIFIC DESCRIPTION OF THE PREFERRED EMBODIMENTS

In FIGS. 1 and 2 of the drawings a presentation pack 1 is in the form of a box having a base 2 and a transparent cover 3. Secured to the base 2 is a two-way adhesive strip 4 which has adhesive on both sides. On the strip 4 are mounted a pair of eyelash sets 5 each convex in side view and having a plurality of lashes 6 held together by a base strand 7. FIG. 1 illustrates clearly that in the present invention the eyelash sets 5 are each removably mounted with their convex side in contact with the supporting surface, in the first embodiment the adhesive strip 4, so that the base strand 7 is left free.

With this first embodiment of the invention the base strands are left free so that curvature in the base strands important for easy application is retained and adhesive can be applied by a user to the base strands of the eyelash sets before removal from the pack thus minimising the handling of the eyelashes. Additionally by providing an adhesive strip within the pack the eyelashes, after use, can be cleaned and returned to the pack until they are required for re-use.

In FIGS. 3 and 4 of the drawings which illustrates a second embodiment the presentation pack 11 has a base member 12 a panel 13 of which is movable relative to the base member 12 about a hinge line 14. The panel 13 of the base member 12 is normally retained in position by an adhesive tab 15.

Releasably mounted on the panel are two plastics applicators 16 having a handle 17 by means of which the applicator may be manipulated and a support portion 18. The support portion 18 is preferably arcuate in plan as shown and supports an eyelash set 19 which is secured thereto.

Each eyelash set 19 is mounted on the support portion 18 with its convex side in contact with and secured to the surface of the support portion 18. Mounting the eyelash sets in this way allows their base strands 20 to be left free so that they may be precoated with adhesive for subsequent easy application to the eyelids of a user. In order to protect the eyelashes from damage before use a transparent cover 21 is secured to the base member 12 and disposed over the movable part 13 - see dotted lines of FIG. 3.

In use a presentation pack 11, as shown in FIG. 3, is taken by a user and the movable panel 13 moved into the position shown in FIG. 4 by pulling tab 15. In this position the applicators 16 may be removed from their mounting by manipulation of handle 17 and the eyelash set mounted thereon applied to the appropriate eyelid as desired.

Conveniently on the back of the pack, as indicated by the arrow A in FIG. 4, there are provided instructions for use which may be read as each applicator 16 is removed.

Although the second embodiment has been particularly described with separate applicators it is understood various modifications may be made e.g. the eyelash sets may be mounted on applicators which form part of the pack and in use are torn away.

I claim:

1. An eyelash presentation pack comprising a pair of eyelash sets each having a plurality of lashes held together by a base strand and said lashes being convex in side view and a supporting surface on which said eyelash sets are releasably adhesively mounted, each said eyelash set being mounted with said convex side in cntact with said supporting surface with said base strand of said eyelash set positioned away from the supporting surface.

2. An eyelash presentation pack according to claim 1 wherein the said supporting surface includes an adhesive tape to which the eyelash sets are mounted convex side downwards to allow easy removal and replacement.

3. An eyelash presentation pack according to claim 1 wherein said supporting surface to which said eyelash sets are adhesively mounted is a support portion of an eyelash applicator having a handle by means of which the applicator may be manipulated.

4. An eyelash presentation pack comprising a supporting surface, a cover secured to said supporting surface, a pair of eyelash sets having a plurality of lashes held together by a base strand, said lashes being convex in side view, and a pair of eyelash applicators each having a base portion surface on which said eyelash sets are releasably adhesively mounted, each said eyelash set being mounted with said convex side in contact with said base portion surface with said base strand of said eyelash set positioned away from the base portion surface to which said eyelash sets are releasably adhesively mounted, each applicator also having a handle by means of which the applicator may be manipulated, said applicators being removably mounted on a portion of said supporting surface that is movable between a first position and a second position so that at least a part of said base portion on which each said applicator is mounted is movable together with the applicator from a first position wherein said cover secured to said supporting surface covers said base portion of said applicators to a second position wherein said applicators may be removed from the base member without damage to the eyelash sets releasably adhesively secured thereto.

* * * * *